US005423561A

United States Patent [19]

Sadow

[11] Patent Number: 5,423,561

[45] Date of Patent: Jun. 13, 1995

[54] ANTI TIP-OVER DEVICE FOR WHEELED LUGGAGE

[75] Inventor: Bernard D. Sadow, Chappaqua, N.Y.

[73] Assignee: Outrigger, Inc., Chappaqua, N.Y.

[21] Appl. No.: 152,218

[22] Filed: Nov. 12, 1993

Related U.S. Application Data

[63] Continuation of Ser. No. 105,782, Aug. 12, 1993, which is a continuation of Ser. No. 881,401, May 11, 1992.

[51] Int. Cl.[6] ..... B62D 21/14

[52] U.S. Cl. ..... 280/37; 190/18 A

[58] Field of Search ..... 190/18 A; 248/130, 291; 280/35, 37, 40, 652, 655, 646, 755

[56] References Cited

U.S. PATENT DOCUMENTS

| | | | |
|---|---|---|---|
| 2,599,354 | 6/1952 | Stableford | 280/646 |
| 2,629,607 | 2/1953 | Roubeck | 280/35 |
| 2,654,421 | 10/1953 | Neff | 280/35 |
| 2,767,995 | 10/1956 | Stout . | |
| 3,329,442 | 7/1967 | DiVietri | 280/35 |
| 3,871,676 | 3/1975 | Renard et al. | 280/35 |
| 3,923,318 | 12/1975 | Renard et al. | 280/35 |
| 4,062,429 | 12/1977 | Tabor et al. | 190/18 A |
| 4,826,194 | 5/1989 | Sakita | 280/755 X |

*Primary Examiner*—Allan N. Shoap
*Assistant Examiner*—Christopher J. McDonald
*Attorney, Agent, or Firm*—Abelman, Frayne & Schwab

[57] ABSTRACT

An article of wheeled luggage is provided with retractible outriggers that can be extended beyond the lateral sides of the article of luggage, thus to provide stabilization for the luggage and militate against accidental tipping over of the luggage during towing of the article of wheeled luggage.

1 Claim, 9 Drawing Sheets

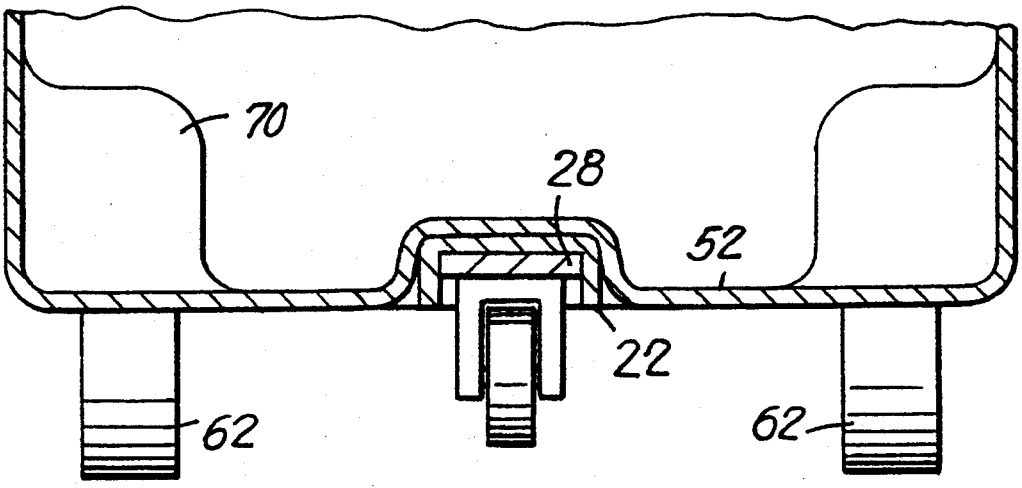
FIG.9
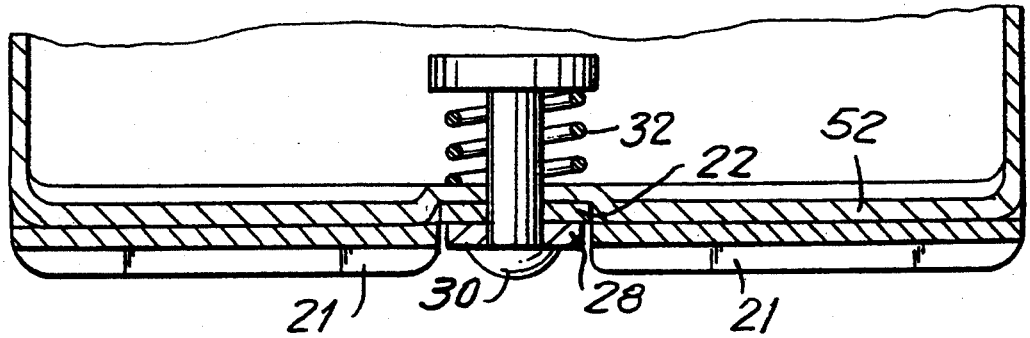
FIG.10
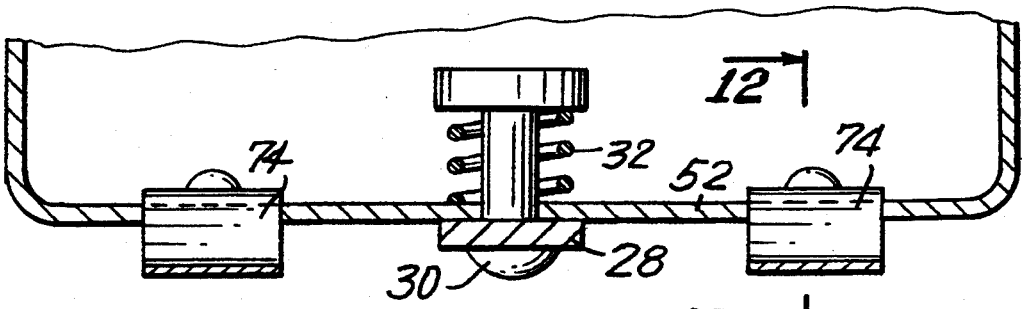
FIG.11
FIG.12
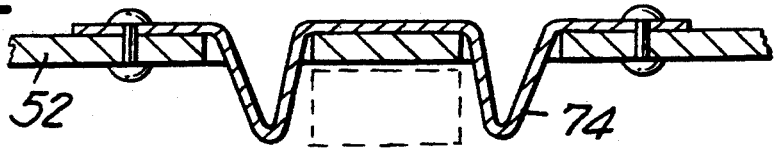
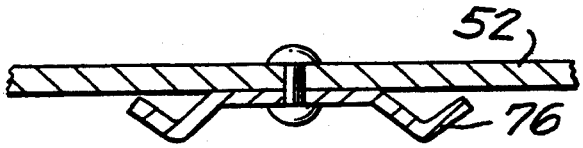
FIG.13

62
62
64
64
68
68
84
84
34
34
78
78
18
18
82
52
66
56
54
58
60
A 80
82
78
78

ANTI TIP-OVER DEVICE FOR WHEELED LUGGAGE

This is a continuation of application Ser. No. 08/105,782 filed on Aug. 12, 1993, which is a continuation of Ser. No. 07/881,401 filed May 11, 1992.

FIELD OF THE INVENTION

This invention relates to a device to be affixed to, or, which can be integrated into, an article of traveler's luggage of a type having wheels to enable towing of the article of luggage behind the user.

BACKGROUND OF THE INVENTION

Wheeled luggage is well-known in the art, such articles of luggage being towed behind a user by means of a strap or cord attached to the article of luggage at a forward end thereof.

Typically, such articles of luggage are of elongate rectangular, or approximately rectangular, transverse cross-section, thus presenting an elongate rectangular or substantially rectangular base. A pair of wheels or rollers is located near one end of the base, the wheels or rollers being mounted for rotation on positionally fixed axles. At the opposite end of the base, there is provided a caster wheel in order to permit ready turning of the case in a following motion as it is towed behind the user.

Luggage of this type is in common usage at such places as airports, railroad stations and bus stations, the luggage then being checked in for transport to the selected remote location.

Checking in of the luggage, and the subsequent handling and storage of the luggage for transportation requires that the luggage be substantially free of external protrusions, in order to minimize the possibility of damage to the luggage during transportation, and, damage to adjacent pieces of luggage during handling and transportation.

Commonly, such articles of luggage are quite large, and, particularly for holiday travelers, may be heavily stuffed and thus quite weighty. Such heavy articles of luggage tend to be unstable while being towed and are readily prone to tipping over, particularly in the event that the user imposes a sharp turn on the article of luggage during towing, the center of gravity of the filled article of luggage lying at any random point within the confines of the article of luggage. Such tipping over of the luggage during towing, not only constitutes an annoyance to the person towing the luggage, but also, can cause accidents and injury in the event that the luggage falls onto a person's leg or feet.

It has been prior proposed in U.S. Pat. No. 2,096,768, issued Oct. 26, 1937 in the name of H. H. Styll to provide an expandable article of luggage with stabilizers to prevent tipping over of the article of luggage when in an expanded condition, the stabilizers being retracted to beneath the case by a cam mechanism at the time the article of luggage is collapsed from its expanded to its contracted position.

While such a mechanism has merit, it cannot accommodate the requirements for luggage that is to be transported in a fully expanded condition, in that at such times, the stabilizers would be rigidly held in an extended position, and thus be prone to damage during handling of the luggage, and, prone to damage other luggage being transported in the same batch.

SUMMARY OF THE INVENTION

It is an object of this invention to provide a device for attachment to an existing article of luggage of the wheeled type, or which can be incorporated into the luggage during the manufacture thereof, the device having the capability of providing stabilizers that can, at the choice of the user, be retracted into the confines of the base of the article of luggage, or, be extended laterally of the base of the article of luggage in the manner of outriggers. The stabilizers or outriggers are provided at their outwardly extending ends with wheels or casters, which are mounted independently in a manner permitting independent rotation of the wheels or casters, thus to permit ready following of the article of luggage when towed in directions that are other than axially straight.

According to the present invention, a support member is provided which is attachable to the base of an article of luggage. The support member includes locating channels arranged with the longitudinal axis of the respective channels extending at an angle to each other, the respective longitudinal axes extending substantially parallel to the base of the luggage when the support member is attached to the article of luggage.

An outrigger arm is pivotally connected to the support member at the intersection of the longitudinal axes of the respective locating channels, the outrigger arm being movable from a first position in which it is confined within one of the locating channels, and a second position in which it is confined within the other of the locating channels.

Resilient means is provided for biasing the outrigger arm into seated engagement within the selected one of the channels, the outrigger arm being movable against the bias in order to permit the outrigger arm to be moved from a position in which it extends substantially longitudinally of the base of the article of luggage, to a position in which the outrigger arm extends transversely of the base of the article of luggage and extends laterally beyond the adjacent side wall of the article of luggage.

In a preferred embodiment of the invention, the outrigger is provided by a single bar that is pivotally mounted at its center on the support member by a resilient mounting pivot. In this embodiment, the outrigger arm can be moved for it to be aligned with the longitudinal axis of the base of the article of luggage, for handling of the luggage during transportation, or, and at the selection of the user, it can be swung about the pivot for the ends of the bar to extend outwardly of the opposite sides of the case.

The bar can be provided at its respective ends with conventional casters or wheels for ground engagement, thus providing the required lateral support for the luggage, thus to prevent accidental tipping-over of the luggage.

The bar can be angular, straight, or, it can be curved or otherwise formed to place the casters in trailing relationship relative to the pivot as related to the direction of towing.

In an alternative embodiment, two such support members are provided that are respectively attached to the base of the luggage adjacent the respective opposite sides of the base, the respective support members each being provided with an outrigger arm having a caster at its free end, such that the outrigger arms are independently extendable beyond the sides of the article of luggage.

In another embodiment of the invention, provision is made for the outrigger arm to be stored in an upwardly displaced position when in its retracted condition, the outrigger being downwardly displaced at the time it is extended transversely of the article of luggage, in order to position the casters or wheels out of ground engagement when the outrigger arm is in the retracted position, and to position the casters or wheels in ground engaging position when the outrigger arm is in an extended position.

As a matter of convenience, the support member itself can be provided by or be formed integrally with the base of the article of luggage during the manufacture of that article, thus removing the necessity to affix a separate support member to the article of luggage subsequent to the manufacture thereof. The possibility of forming the support member integrally with the article of luggage exists particularly in the event that the frame, and thus the base, of the article of luggage is of molded construction. If the frame of the luggage, as is well-known, is a hard frame, or the article of luggage is of assembled leather construction, it is then more convenient to attach the support member to the frame of the luggage during assembly of the article of luggage.

In the event that the article of luggage has not been provided with a device of the present invention, such a device readily can be added to an existing such an article of luggage, a convenient manner of attaching the support member to an assembled article of luggage being by the use of a conventional pop-riveting device.

DESCRIPTION OF THE DRAWINGS

The invention will now be described with reference to the accompanying drawings, which illustrate preferred embodiment of the invention, and, in which:

FIG. 9 is a transverse cross-section through the article of luggage taken on the line 9—9 in FIG. 6;

FIG. 10 is a transverse cross section through the article of luggage of FIG. 6 taken on the line 10—10;

FIG. 11 illustrates a modified form of the cross-section of FIG. 10;

FIG. 12 is a cross-section taken on the line 12—12 of FIG. 11;

FIG. 13 is a modified form of the structure of FIG. 12;

DESCRIPTION OF THE PREFERRED EMBODIMENTS

Figure 1:
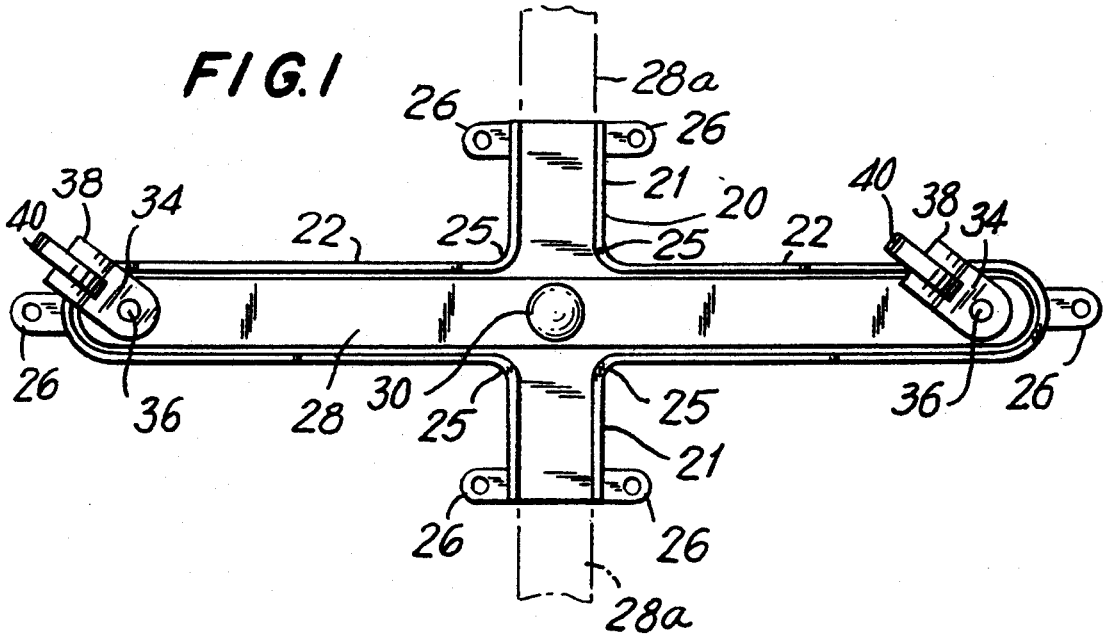
FIG. 1 is an underside plan view of the device, shown in a retracted position.
Figure 2:
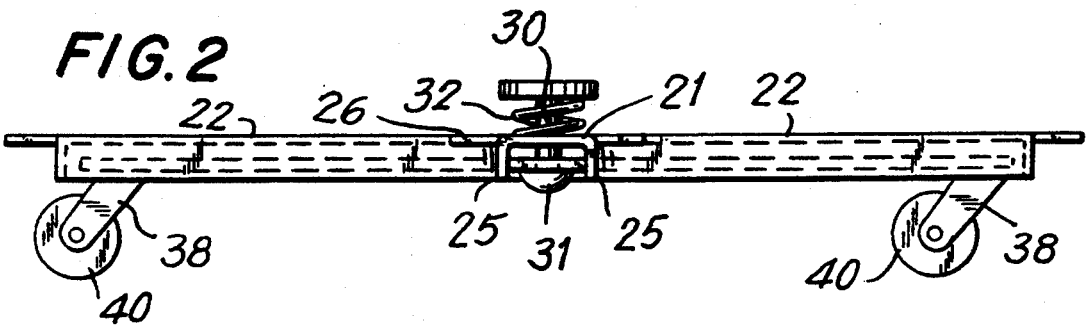
FIG. 2 is a side elevation of the device, showing the device in the position it normally will occupy in use.

Referring firstly to FIGS. 1 and 2, the device of the invention includes a base member 20, which conveniently can be manufactured as a die casting of a suitable metal, or, as a molding of a suitable thermoplastics material.

The base member 20 is in the form of a cross providing arms 21 and 22, which, in the embodiment of FIG. 1, extend at right-angles to each other.

The respective arms 21 and 22 each are of channel cross-section, as more clearly illustrated in FIG. 2, the respective arms 21 and 22 each having a flange 25 extending longitudinally of the opposite longitudinal edges thereof. In this manner, the respective arms provide a cruciform arrangement of channels, one extending longitudinally of the major dimension of the device, and the other extending transverse thereto, the respective channels being interconnected one with the other at the center of the device.

Conveniently, the arms 21 and 22 can be provided with ears 26, whereby the device can be mounted onto the underside of an article of luggage by means of screws, pop-rivets, or other suitable fastening devices.

Secured within the channels of the arms 21 and 22, is an elongate bar 28, the bar 28 being pivotally attached to the base member 20 at the intersection of the respective channels by means of a hinge pin 30 having a head 31 engaged with the bar 28, the hinge pin being biased by a spring 32 operative to bias the bar 28 into seated engagement within the associated channel, and, to retain it in that position until such time as it is manually withdrawn from the channel against the bias of the spring 32, at which time the bar can be rotated about the hinge pin 30, thus allowing the bar 28 to be transferred from the arms 22 into the arms 21, the bar 28, upon release of the manually applied force then being biased into seating engagement with the arms 21, as indicated the chain-dotted lines 28*a*.

At each of its ends, the bar 28 carries a castor 34 of conventional construction, such a castor including a pivot pin 36, on which an arm 38 is mounted for free swinging movement, the respective arms 38 each providing a support for a freely rotatable ground engaging wheel 40.

Figure 6:
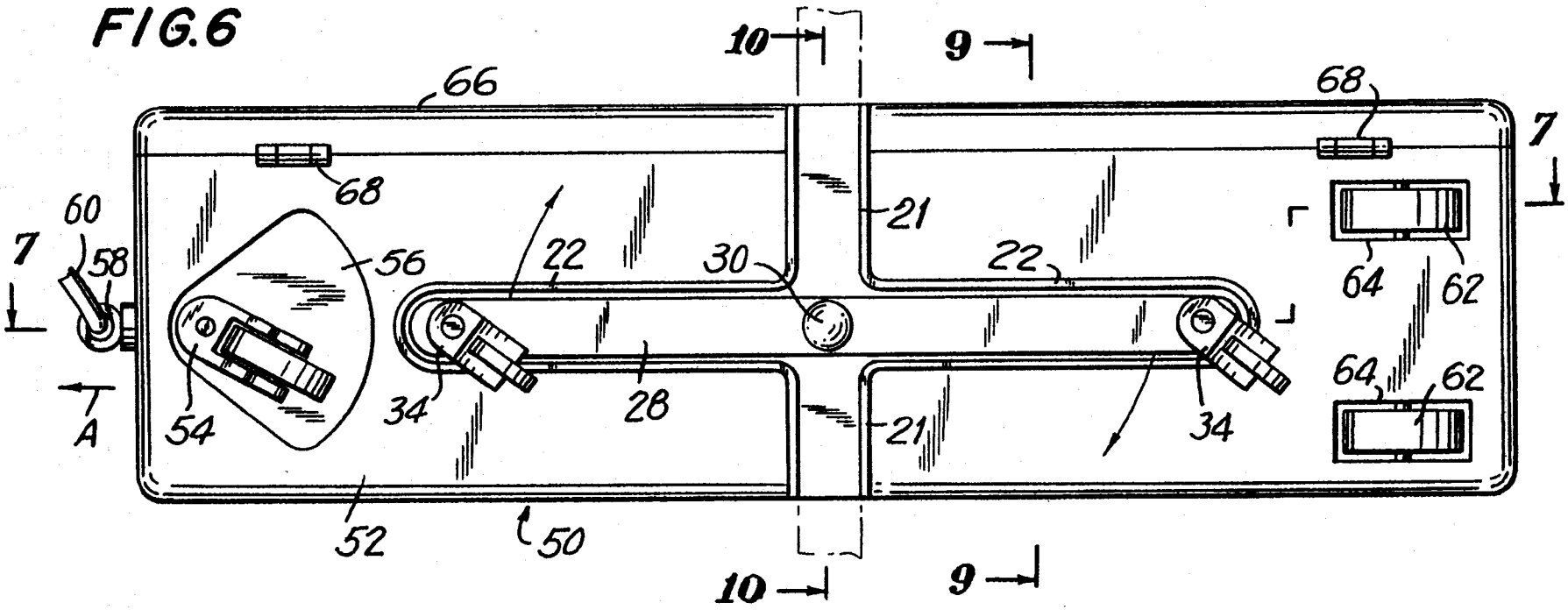
FIG. 6 is an underside plan view of a conventional article of luggage, and showing the device of the invention incorporated directly into that article of luggage.

The device of FIGS. 1 and 2 is intended to be affixed to the base of an existing article of wheeled luggage, such as is illustrated in FIG. 6, with the arms 21 extending transversely of the base and the arm 22 extending longitudinally of the base of the article of luggage, the device being permanently affixed to the base of the article of luggage in that orientation by any convenient form of fastening means, as is discussed above.

If the article of luggage is to be stored, for example, for transportation between one location and another, then, the bar 28 is to be manually positioned in the channel-sectioned arms 22. In position the bar 28 extends longitudinally of the base of the article of luggage, with the castors 34 positioned beneath the base of the article of luggage. If the article of luggage is to be manually towed, for example, between one airport depot and another, then, the user, with ease, can withdraw the bar 28 from the channel section arms 22, rotate it about the hinge pin 30 and into alignment with the channel section arms 21. The bar 28, upon manual release, is then biased into seating engagement with the channel section arms 21 in a position in which the bar 28 extends transversely of the base of the article of luggage. The castors 34 are then positioned, respectively, spaced outwardly of the respective sides of the article of luggage, thus to provide stabilizers for the article of luggage that act to retain the article of luggage in its intended vertically oriented position, and, militating against the possibility of tipping-over of the luggage, as it is towed by the user, possibly at high speed, over terrain that is not necessarily continuously smooth. Tipping-over of conventional wheeled luggage commonly occurs at times when the article of luggage is being towed on a tortuous path, and is being caused to corner at speed.

If convenient, the device of FIGS. 1 and 2 can be packaged as an "add-on" unit of appropriate dimensions for securement by the user to the base of an existing article of wheeled luggage. The user or the vendor of the device can then affix the device to the existing article of wheeled luggage using simple tools, the sole requirement being for a screwdriver in the event that self-tacking screws, such as sheet metal screws, are employed. More preferably, pop rivets can be employed for that purpose, the requirement then being for a small drill, which can be a cordless drill, for making holes at the appropriate locations in the existing article of luggage, and, a conventional pop-riveting plier.

In the alternative, the device can be applied to the base of an existing article of wheeled luggage by means of double-sided adhesive tape, or, by any other suitable adhesive.

When it is required that the castors 34 and the arm 28 be retracted, for the purpose of storage of the article of luggage, it is then merely necessary for the user to manually withdraw the bar 28 from the channel section arms 21, and, return it to its initial position in which it is seated within the channel section arms 22.

Figure 3:
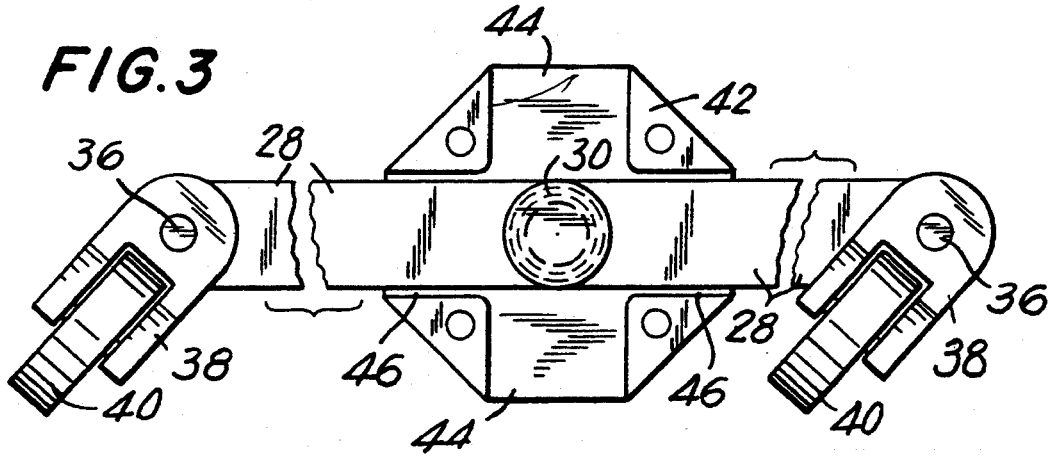
FIG. 3 is an underside plan view of a modified form of the device of FIG. 1.

FIG. 3 illustrates a modification of the structure of FIGS. 1 and 2, to again provide a device of the invention that can be attached to an existing article of luggage.

Figure 4:
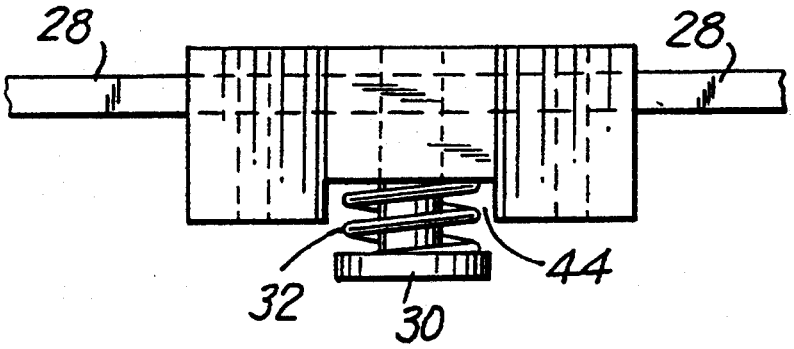
FIG. 4 is a fragmentary side elevation of a portion of the device shown in FIG. 3.

In FIGS. 3 and 4, the arm 28, the castors 36–40, and the hinge pin 30 and its biasing spring 32 each are included, the base member 20 having been replaced by a base member 42, which, conveniently, can be a casting, stamping or molding of a suitable metal or plastics material. The base member 42 can be of square, circular or polygonal shape, or, of any other shape that will provide channels 44 and 46 that intersect each other substantially at right angles.

The use and method of securement of the device of FIGS. 3 and 4 is the same as that described with reference to the device of FIGS. 1 and 2. The device of FIGS. 3 and 4 can, however, provide an additional advantage that is not readily realized by the structure of FIGS. 1 and 2.

Figure 5:
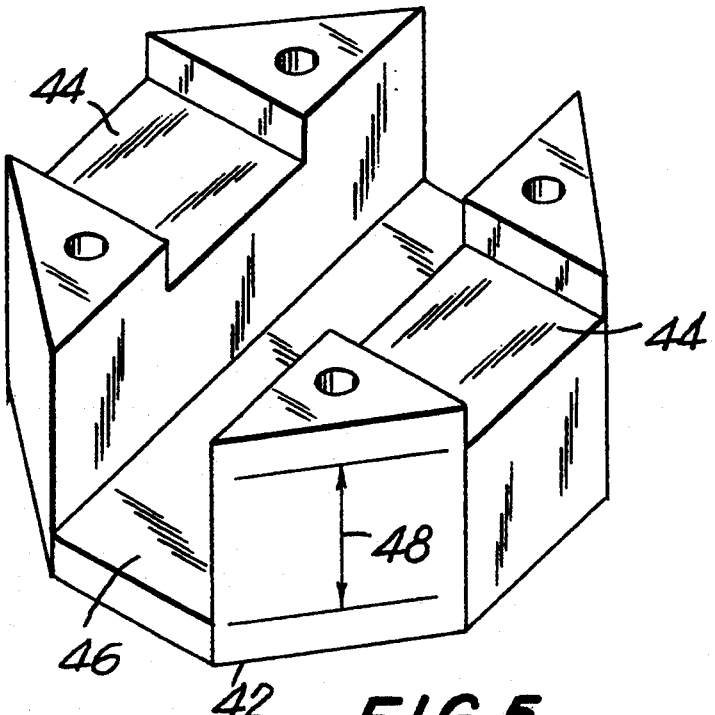
FIG. 5 is a perspective view of a mounting block incorporated into the device of FIGS. 3 and 4.

Referring now to FIG. 5, the base member 42 is formed with channels 44 and 46 that are arranged at two different levels. Thus, with the base member 42 of FIG. 5, the bar 28 can be stored for "non-use" at a position closely adjacent to the base of the associated article of wheeled luggage, the castors in that position, then having been withdrawn from ground engagement. If stabilization of the article of luggage is then required for towing of the article of luggage, the bar 28 can be withdrawn from the relatively deep channel 46, and then be re-positioned in the relatively shallow channel 44, in which position the bar 28 will have been moved downwardly from the base of the article of luggage by the distance indicated by the arrows 48, the castors then being properly positioned for ground engagement.

While the provision of a base member such as the base members 20 and 42 is preferable, as is discussed later with respect to FIGS. 11 and 12, the provision of a base member is not mandatory. As is described with reference to FIGS. 11 and 12, the bar 28 can be pivotally secured directly to the base of the article of luggage, and, spring clips can be provided for holding the bar in the retracted position in which it extends longitudinally of the base of the article of luggage, and in the extended position in which the bar 28 extends transverse to the base of the article of luggage.

The device of the invention as so far described has been in relation to an "add-on" device for an existing article of wheeled luggage. Equally well, the device of the present invention can be integrated into an article of wheeled luggage at the point of manufacture of that article of wheeled luggage, as will now be described with reference to FIGS. 6–17 of the accompanying drawings.

Figure 7:
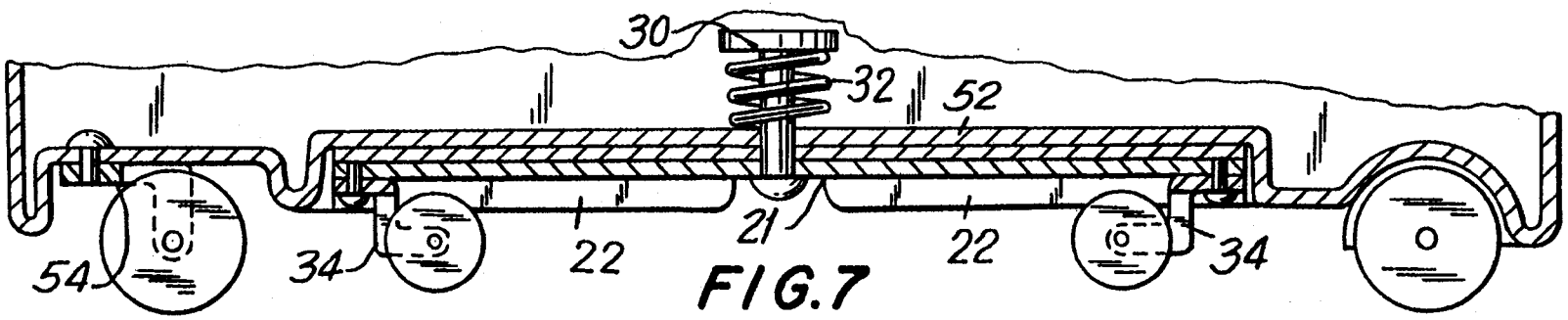
FIG. 7 is a longitudinal cross-section taken on the line 7—7 of FIG. 6.
Figure 8:
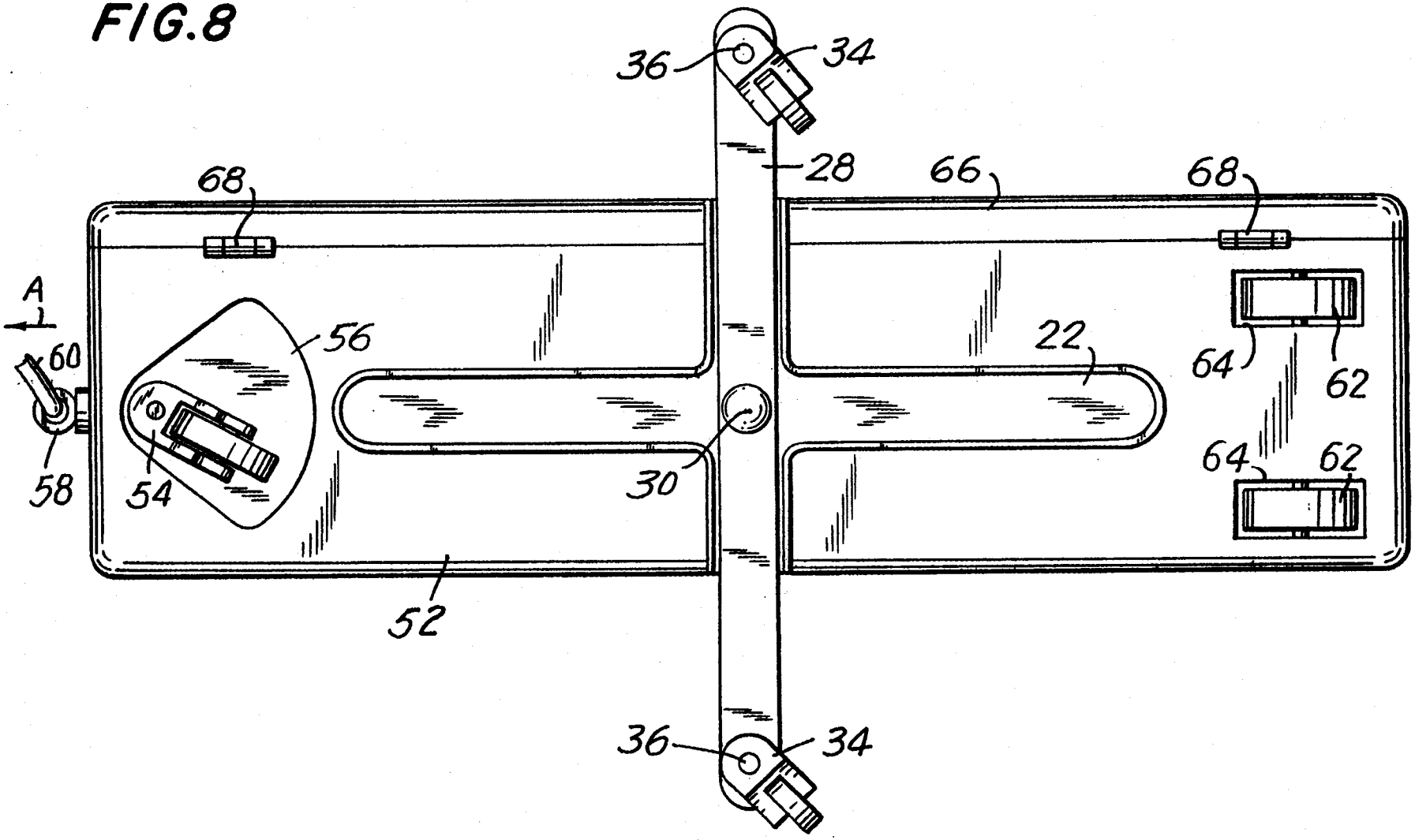
FIG. 8 is an underside plan view of the article of luggage showing the device of the invention in an extended position.

Referring now to FIGS. 6, 7 and 8, there is shown the base of a conventional article of wheeled luggage, into which the device of the present invention has been integrated. The body of the article of luggage is indicated generally at 50, the article of luggage having the configuration of a suitcase.

The base 52 of the suitcase is provided at one end with a castor wheel 54, which can be partially inset into the base in a recess 56, and is provided at that end with an eyelet or other member permitting the attachment of a stowing strap or cord 60.

The opposite end of the case is provided with ground wheels 62, which conveniently are partially inset into the base of the case in recesses 64, the respective wheels 62 being mounted independently on axles, thus to permit rotation of the respective wheels relative to each other, and, accommodate "cornering" of the suitcase as it is being towed.

The suitcase is provided with a conventional lid 66, which is hinged to the base 52 by conventional hinges 68.

The base of the case is channelled, whereby to provide the respective arms 21 and 22 of the device of FIG. 1 directly within the base of the suitcase. In the same manner as described with reference to FIGS. 1–4, a bar 28 is pivotally hinged to the bottom of the suitcase by a hinge pin 30, the hinge pin 30 being resiliently biased by a spring 32, in order to hold the bar 28 securely seated in either the channel 22 as shown in FIG. 6, or, in the channel 21 as shown in FIG. 8.

As is illustrated more particularly in FIG. 7, in the event that the base of the suitcase is formed as a metal stamping, or, as is commonly the case, a molding of fiberglass or plastics material, then, the bottom face of the case can be appropriately contoured such that the channels 21 and 22 are provided within the confines of the base, suitable reliefs being provided to accommodate the castor 54 and the wheels 62.

FIG. 9 is a transverse cross-section taken on the line 9—9 of FIG. 6, FIG. 9 showing the disposition of the respective members when the bar 28 is in a stored position. FIG. 10 is a cross-section taken on the line 10—10 of FIG. 6, and illustrates the manner in which the castors can be advanced from a stored position in which they are out of ground engagement to an extended position in which the castors are available for ground engagement. As is illustrated in FIG. 10, the channel 22 is provided at a level higher than that of the channel 21, thus providing the benefits of the base member 42 of FIG. 5.

It is, of course, not essential that the base 52 of the suitcase be channeled in the manner illustrated in FIGS. 7 and 8. Instead, the base 52 of the suitcase can be left in the well-known planar condition, locating members for the bar 28 then being provided by spring members 74, as illustrated in FIGS. 11 and 12, or, spring members 76 as illustrated in FIG. 13.

In FIGS. 11 and 12, the spring members 74 are generally of W-shape, the legs of the W extending through slots in the base of the case and into the path of movement of the bar 28. The provision of such spring clips that are retractible within the case then makes the resilient biasing of the bar 28 unnecessary, thus permitting the hinge pin 30 to be attached directly to the base 52 of the case.

FIG. 13 illustrates an extension of this concept, in which the locating means for the bar 28 is provided by spring clips 76 attached directly to the base 52. In the construction of FIG. 13, resilient biasing of the hinge pin 30, while desirable, is in fact not essential in that the arms of the spring clip 76 will flatten down as the bar 28 is passed over them.

Figure 14:
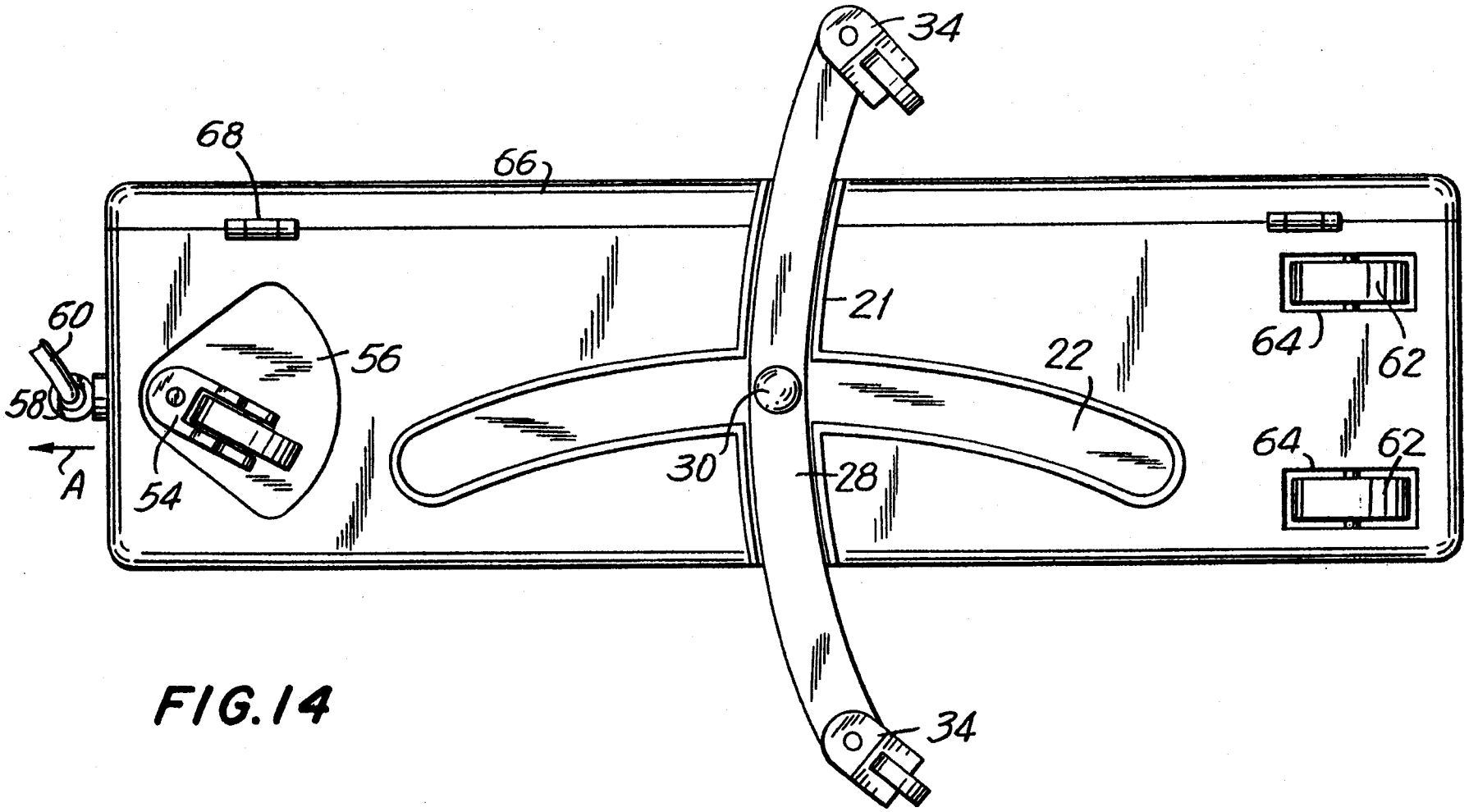
FIG. 14 is an underside plan view of a modified form of the device, corresponding with FIG. 8 of the drawings.

In the constructions so far described, the bar 28 has been illustrated as being axially straight. In the embodiment of FIG. 14, the bar 28 is made of curved arcuate form, the channels 21 and 22 being curved correspondingly. In this manner, the castors 34 are caused to trail the hinge pin 30 in the direction A of towing of the article of luggage. The trailing of the castors 34, as illustrated in FIG. 14, has the desirable effect of reducing "Jiggle" of the castors, and reducing the objectionable noise caused thereby during towing of the article of luggage.

Figure 15:
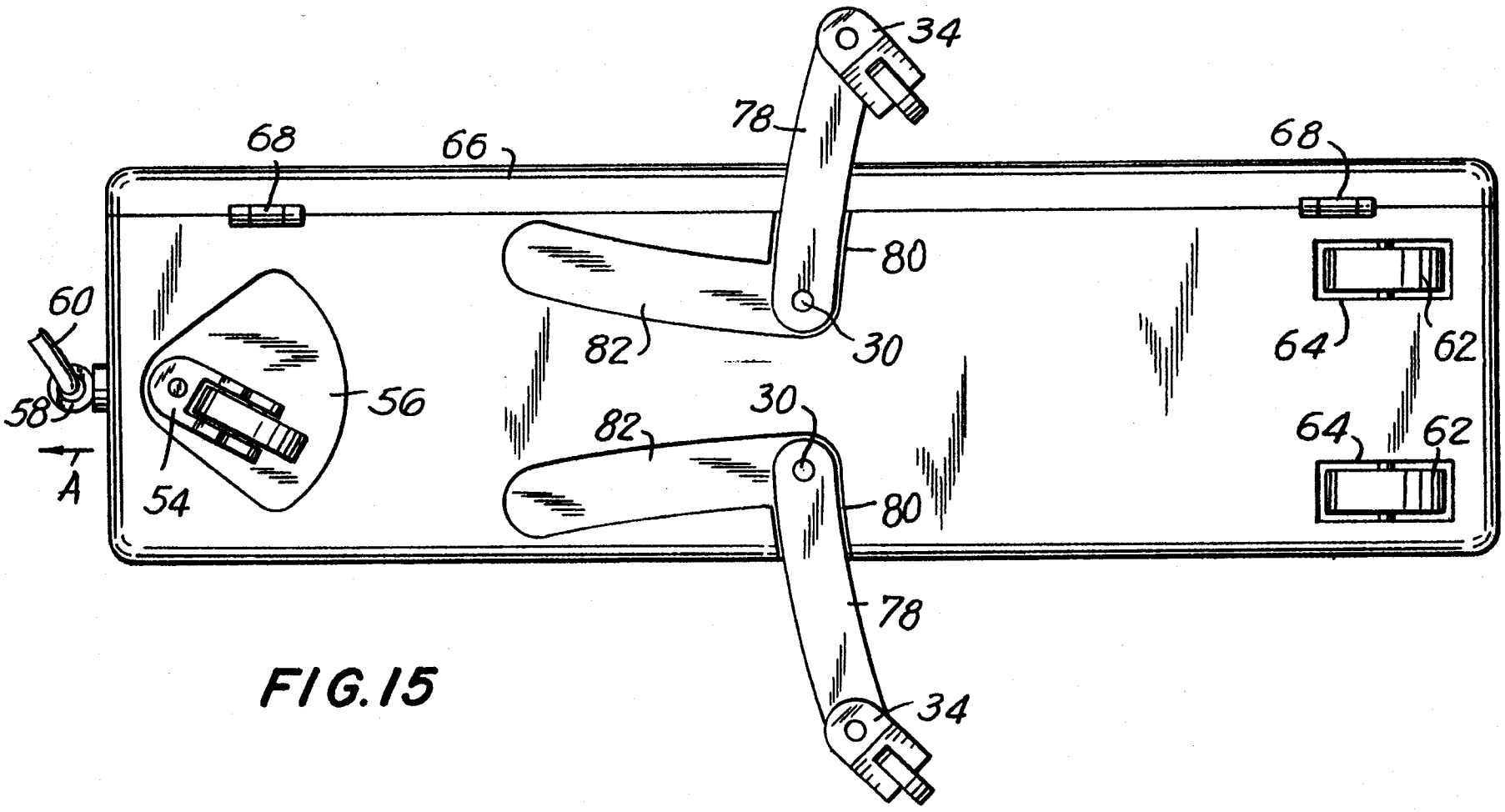
FIGS. 15, 16 and 17 illustrate alternative embodiments of the device of the invention.
Figure 16:
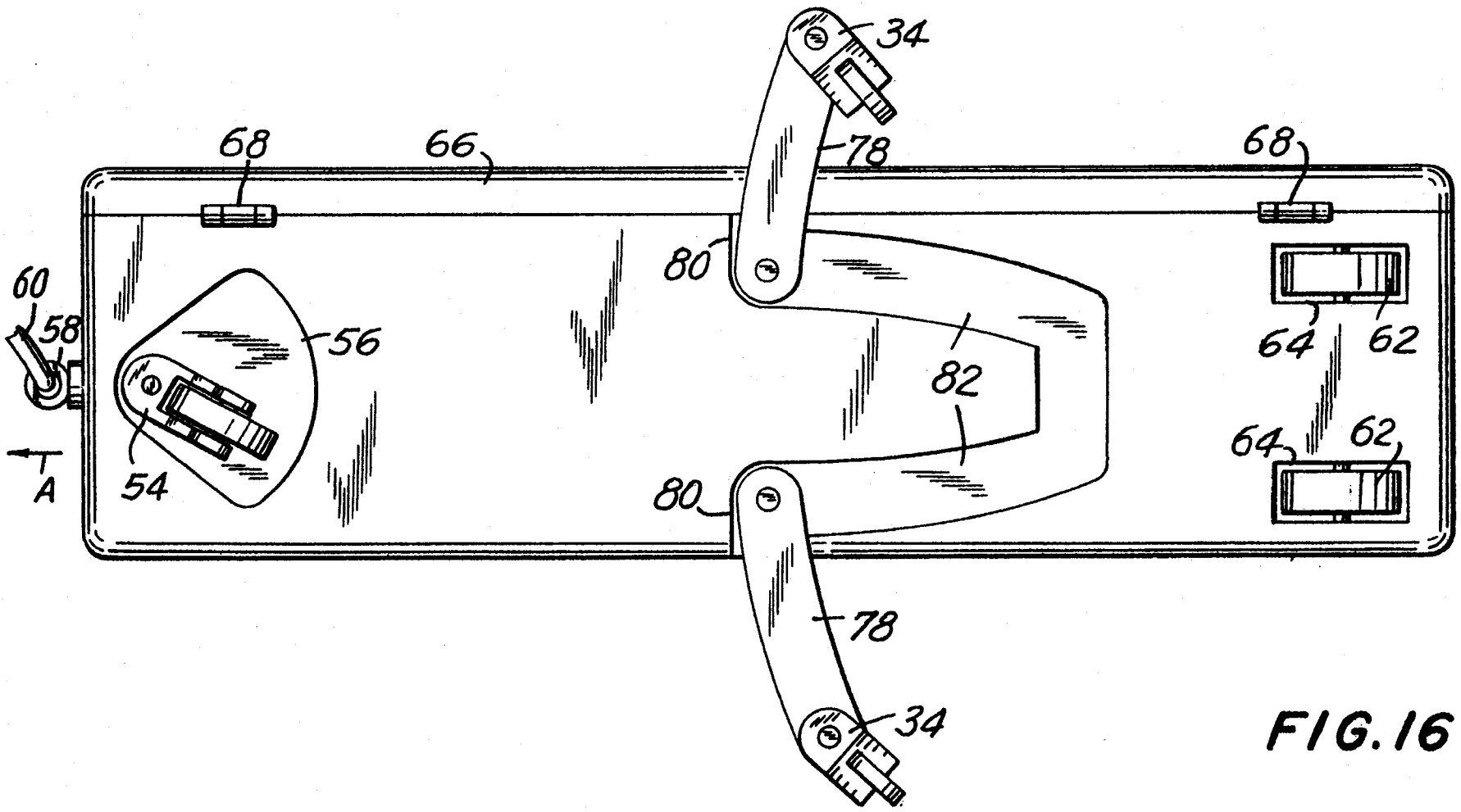

FIGS. 15 and 16 illustrate an alternative embodiment of the device of the present invention, in which the bar 28 is split into two bar sections 78, each provided with a hinge pin 30, the respective bar sections 78 thus being independently hinged to the base 52, and movable between channels 80 and 82, a resilient bias for the respective hinge pins being provided as previously discussed.

FIGS. 16 illustrates an embodiment similar to that of FIG. 15, in which the bar sections 78 are retractible in a direction towards the wheels 62, as opposed to the retraction of the bar sections 78 in a direction away from the wheels 62 as shown in FIG. 15.

Figures 17, 18:
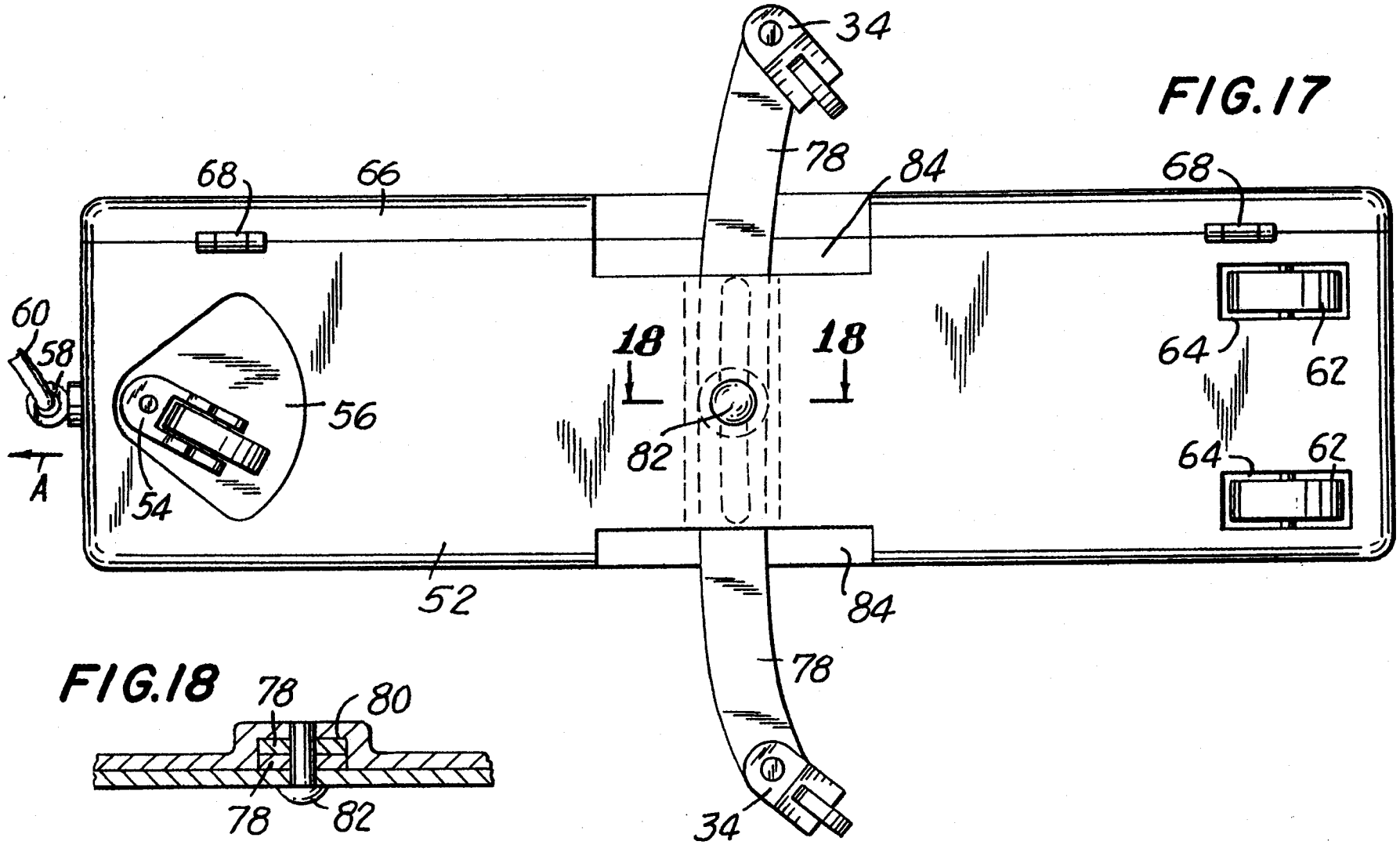
FIG. 18 is a view along line 18 of FIG. 17.

FIGS. 17 and 18 illustrate a further embodiment of the present invention. In FIG. 17, the bar sections 78, instead of being hinged to the base of the suitcase are slidable within a tubular guide 80 formed in the base of the case 52, the bar sections 78 being frictionally restrained against longitudinal movement, and, preferably guided by a pin 82 that limits the extent of longitudinal movement of the bar sections 78 in the inwards storage position and the outwards extended position. In this construction, recesses 84 can be provided in the base 52 and lid 66 of the suitcase, thus permitting the castors 34 to be stowed within the confines of the base of the suitcase.

As will be readily appreciated by those skilled in the art, a multitude of choices present themselves as to the materials to be employed in the manufacture of the article of luggage and of the device of the present invention., While the invention dominantly has application in what is known as hard luggage and hard frame luggage, the former of which is substantially rigid in all of its surfaces, and the latter of which has a substantially rigid tubular frame, the invention also can be adapted to what is known in the trade as soft luggage by the incorporation into the article of soft luggage of a base plate corresponding with the base 52, thus to provide the necessary support for the bar or bar sections 28 and 78, the respective castors 34 and 54, and, the respective support wheels 62.

What I claim is:

1. A device specifically for attachment to an article of wheeled luggage to provide a stabilizer against tipping over of said article of wheeled luggage, comprising:

a rigid member, including means for securing said rigid member to a base of said article of luggage;

a carriage member secured to said rigid member, said carriage member having at least one caster wheel;

pivot means permitting pivoting movement of said carriage member relative to said rigid member;

resilient spring means biasing said carriage member towards and into engagement with said rigid member;

first stop means provided on said rigid member prohibiting pivotal movement between said carriage member relative to said rigid member when said rigid member and said carriage member are engaged with one another in a first position of adjustment; and, second stop means provided on said rigid member prohibiting pivotal movement of said carriage member relative to said rigid member when said rigid member and said carriage member are engaged with one another in a second position of adjustment;

said resilient spring means permitting movement of said carriage member away from said rigid member for adjustment between said first and second positions of adjustment;

whereby, when said rigid member is secured to a base of a said article of wheeled luggage, said carriage member is adjustable between a first position of adjustment substantially in line with said base of said article of wheeled luggage, and a second position in which said carriage member extends laterally beyond side edges of said base of said article of wheeled luggage.

* * * * *